US008544890B2

(12) United States Patent
Whitehead

(10) Patent No.: US 8,544,890 B2
(45) Date of Patent: Oct. 1, 2013

(54) APPARATUS AND SYSTEM FOR REGAINING OR MAINTAINING BALANCE IN SNOW

(76) Inventor: Dean Whitehead, Eagle Mountain, UT (US)

( * ) Notice: Subject to any disclaimer, the term of this patent is extended or adjusted under 35 U.S.C. 154(b) by 567 days.

(21) Appl. No.: 12/573,796

(22) Filed: Oct. 5, 2009

(65) Prior Publication Data

US 2011/0079994 A1 Apr. 7, 2011

(51) Int. Cl.
*A63C 11/00* (2006.01)

(52) U.S. Cl.
USPC ..... 280/809

(58) Field of Classification Search
USPC ..... 280/810, 818, 819, 821, 809, 816, 280/826, 842, 813, 602, 824, 601, 607
See application file for complete search history.

(56) References Cited

U.S. PATENT DOCUMENTS 3,826,518 A * 7/1974 Hennig ..... 280/813
3,885,805 A * 5/1975 Solymosi ..... 280/606
4,006,911 A * 2/1977 Kraus et al. ..... 280/809

* cited by examiner

*Primary Examiner* — John Walters
*Assistant Examiner* — James Triggs
(74) *Attorney, Agent, or Firm* — Goucher Patent Law PLLC; Tyler R. Goucher

(57) ABSTRACT

An apparatus that receives a pole tip and assists a user to achieve a standing position in snow is disclosed. The apparatus includes a pole tip receiving member having a base and a pole tip engagement. The pole tip engagement engages a tip of a pole limits lateral movement of the pole with respect to the pole tip receiving member. a coupling secures the pole tip receiving member to the snow traversal device. Engagement of the pole by the pole tip receiving member transfers a pressure applied by the pole to a supporting substrate of the snow traversal device. The transfer of the pressure applied by the pole increases the effective surface area of the pole.

20 Claims, 8 Drawing Sheets

APPARATUS AND SYSTEM FOR REGAINING OR MAINTAINING BALANCE IN SNOW

BACKGROUND

1. Field of the Invention

This invention relates to hiking, skiing, snowboarding, or traveling in snow and more particularly relates to enabling the use of ski poles in soft, deep snow to regain or maintain balance or footing.

2. Description of the Related Art

When hiking, skiing or traveling through snow, travelers often experience difficulties and dangers associated with soft, deep snow. Snow may accumulate to be deeper than the height of a grown adult and may be soft enough that a human would sink over his or her head in snow and find it difficult to get air. In addition, the cold temperature, quick loss of heat, and extreme struggle necessary to get out of deep powder can lead to delay in travels, extreme exhaustion, or even death. Even soft snow with depths much less than the height of a human can necessitate extreme effort to travel and often cause dangers.

Often individuals who travel on snow use snow traversing devices to make it easier to stay on top of the snow and lower the energy that must be expended to travel even small distances. These devices generally operate by spreading the weight of the user over a larger surface area than would be available from the soles of the feet alone. Some of those most well known in the art include snowshoes, skis, and snowboards. For example, snowshoes have a much greater surface area than a normal shoe or boot. This spreads an individual's weight over an increased area of snow and allows for greater "flotation" on the surface. The shoes are also shaped generally with a curved up tip in the front which reduces drag as an individual walks. The increased area and curved up tip are very common to snow traversing devices including snowshoes, skis, snowboards, and the like. These features allow for extremely reduced energy requirements to travel a given distance when compared with travel on normal shoes only. So long as the user remains on his or her feet the devices help the individuals to remain on or near the surface of the snow.

However, given that the snow traversing devices are much different from normal shoes worn by individuals when walking or traveling, and given that the terrain upon which an individual is walking can be very unpredictable, it can be difficult to maintain balance. Individuals often fall when using snow traversing devices. Thus, it often is necessary for an individual to steady himself or stand after a fall using his arms and poles. The poles may allow an individual to maintain balance when he would otherwise fall by holding onto one end of the pole and pushing the distal end into the ground or another hard surface.

In deep and soft snow, however, the poles provide little or no assistance because there are no hard surfaces accessible to the individual. Pushing the distal end of a pole into the snow is useless because is simply sinks into the snow. Although many ski poles have baskets on the end to increase surface area, the surface area is usually far too little to make any difference. The problem is that a basket large enough to provide sufficient support is unwieldy and awkward. Thus, snow travelers tend to make do with smaller baskets and little or no support for the upper body when in deep snow.

SUMMARY

From the foregoing discussion, it should be apparent that a need exists for an apparatus and system for maintaining or regaining balance in soft snow. Beneficially, such an apparatus, system, and method would overcome the above mentioned deficiencies of poles that simply sink into soft snow and lack support to balance the upper body.

The present invention has been developed in response to the present state of the art, and in particular, in response to the problems and needs in the art that have not yet been fully solved by currently available snow traversing systems. Accordingly, the present invention has been developed to provide an apparatus and system for receiving a pole tip to assist a user to achieve a standing position in snow that overcomes many or all of the above-discussed shortcomings in the art.

The apparatus, in one embodiment, includes a pole receiving member and a coupling. The pole tip receiving member includes a base and a pole tip engagement. The pole tip engagement engages a tip of a pole limits lateral movement of the pole with respect to the pole tip receiving member. The coupling secures the pole tip receiving member to a snow traversal device. Engagement of the pole by the pole tip receiving member transfers a pressure applied by the pole to a supporting substrate of the snow traversal device. The transfer of the pressure applied by the pole increases the effective surface area of the pole.

In certain embodiments the pole tip engagement member includes a pocket having an opening sized to receive the tip of the pole. The pocket includes an inner wall that limits lateral movement of the pole.

In one embodiment the pocket includes a floor and the inner wall of the pocket is tapered such that a cross sectional area of the pocket at the opening is greater than a cross sectional area of the pocket at the floor.

In a further embodiment the opening of the pocket is circular and disposed around a central axis. The inner wall of the pocket includes a plurality of consecutively smaller openings concentrically disposed around the central axis. In this manner the pocket is stepwise tapered from a larger area at the opening to consecutively smaller openings with the pocket terminating at the floor.

The apparatus, in one embodiment, includes a sloped outer wall to facilitate engagement of the pole within the pole tip engagement. The sloped outer wall smoothly transitions from the opening of the pocket to the base member to allow the tip of the pole to engage the pole tip engagement without snagging an edge on the pole tip receiving member.

In another embodiment the base member includes a planar member having an orifice disposed through the base member. In such an embodiment the pole tip is engaged by inserting the pole tip into the orifice.

In certain embodiments the pole tip engagement is a stop configured to arrest movement of a pole tip across the supporting substrate of the snow traversal device. In other embodiments the pole tip engagement is a textured surface configured to engage a tip of the pole. In one embodiment the pole tip engagement is a pliable material that dynamically forms a stop for the tip of the pole when pressure is applied to the pole. The pliable material deforms to stop movement of the tip of the pole.

In certain embodiments the pole tip receiving member also includes an attaching member that attaches the tip of the pole to the pole tip receiving member. The attaching member restricts withdrawal of the tip of the pole from the pole tip receiving member so that a user can pull on the pole to stand up.

The apparatus, in another embodiment, is an orifice in a top surface of a supporting substrate of the snow traversing device. In such an embodiment the base member is the top surface of the supporting substrate of the snow traversing device.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

For purposes of the present description and the appended claims the term "snow traversing device" is used to refer to any type of non-motorized device or apparatus which is used to travel over snow. This term is meant to refer broadly to all types of snow traversing devices including Nordic skis, alpine skis, telemark skis, alpine touring skis, split snowboards, snowboards, monoboards, snow skates, sleds, snow bikes, snow scooters and the like.

For purposes of the present description and the appended claims the term "pole" is used to refer to any type of pole used by the arms of skiers, hikers, and snowboarders to assist in maintaining or regaining balance or footing. The term "pole" also includes the poles or legs of tripods, bipods, or other devices used to steady cameras, telescopes, spotting scopes, or the like. Examples of poles that are included in this term include ski poles, hiking poles, adjustable climbing poles, telescopic ski poles, telescopic hiking poles, tripod legs and bipod legs. In one embodiment the pole may include an ice axe or other ice climbing or ascending device having a pole like handle.

Figure 1:
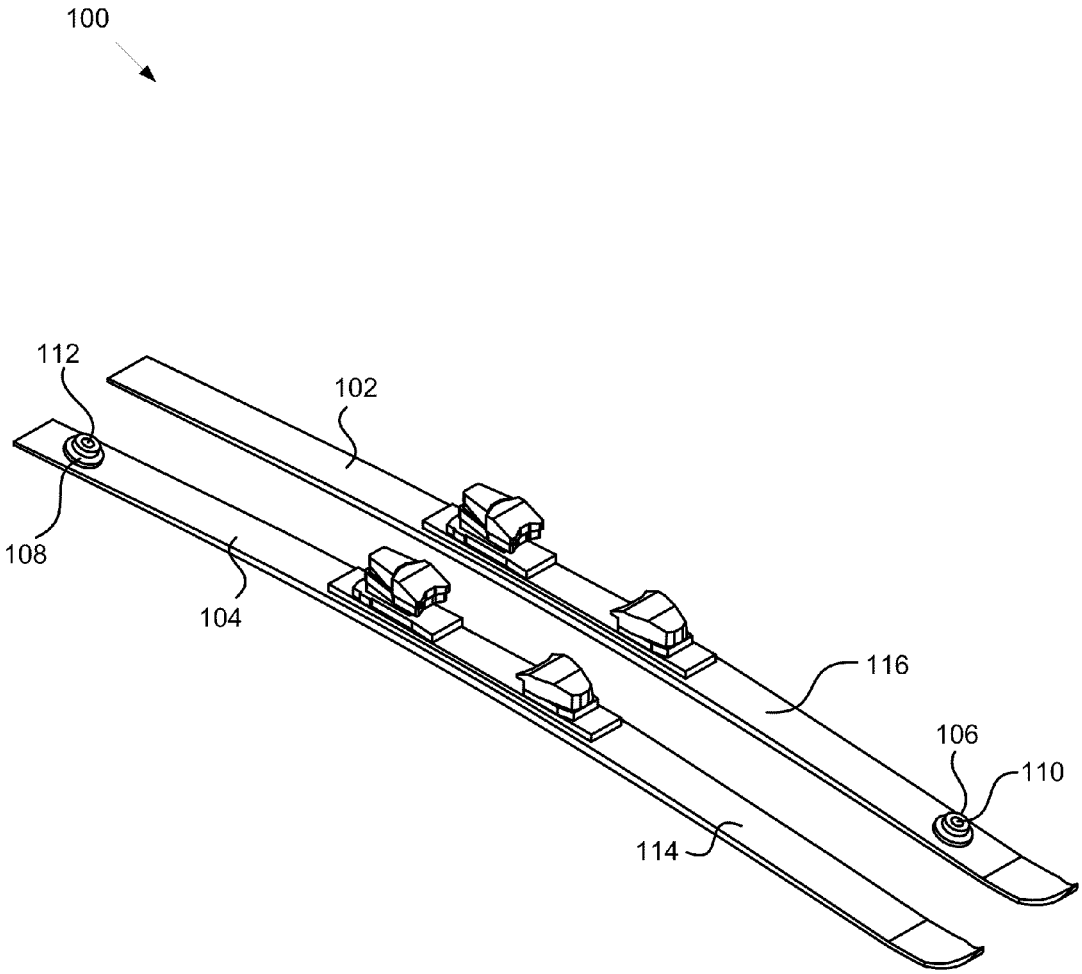
FIG. 1 is an illustrative perspective view of a snow traversing system in accordance with one exemplary embodiment of the invention described herein.

FIG. 1 depicts a snow traversing system 100 utilizing pole tip receiving members 106 and 108 having pole receiving features as described herein. The system 100 includes a first ski 102 and a second ski 104 having, respectively, a first pole tip receiving member 106 and a second pole tip receiving member 108 coupled to a supporting substrate or top surface 114 and 116 of each ski 102 and 104. While the embodiment illustrated in FIG. 1 shows a first and second pole tip receiving members 102 and 104 respectively, one of skill in the art will recognize that in certain embodiments the system may include four pole tip receiving members, one at each end of the first ski 102 and the second ski 104. In another embodiment the system may include only one pole tip receiving member located on only one of the ski's 102 or 104.

The pole tip receiving members 106 and 108 each comprise a top side having a pole tip engagement 110 and 112 respectively. The pole tip engagements 110 and 112 are configured to engage the tip of a pole. When the tip of a pole is placed on or in the pole tip engagements 110 or 112 of the pole tip receiving members 106 and 108 the pole tip engagements 110 or 112 maintain the tip in substantially the same position and limit any lateral movement of the pole tip. Thus, a user can place the tip of a pole on or in the pole tip engagements 110 or 112 to transfer the pressure applied by the pole to the supporting substrate, in this case the top surface 114 or 116 of each ski 102 or 104 respectively. By transferring the pressure applied by the pole to the snow traversal device 102 or 104, the effective surface area of the pole is increased. This allows the user to apply a much greater pressure to the pole without causing the pole to sink in the snow.

The pole tip receiving members 106 and 108 can take a variety of forms with various advantages. For example, according to one exemplary embodiment, the pole tip receiving members 106 and 108 may comprise a non-skid surface such as a textured metal, rubber, or plastic. Each non-skid surface has possible variations in texture, structure, degree of hardness and grip.

Generally, the pole tip receiving members 106 and 108 are not limited to being configured to receive only ski poles. In certain embodiments the pole tip receiving members 106 and 108 may be configured to receive ski poles, the legs of a tripod or any other pole shaped device.

The snow traversing system 100 shown comprises a pair of alpine skis 102 and 104 and is thus primarily designed for skiing or traversing down slopes. When there is deep powder snow and an individual wrecks, or sits down, it may be very difficult to find support to regain an upright position to continue down a slope. Using the exemplary snow traversing system 100 of FIG. 1, a user may find support for the upper body even in the deepest snow. A user may place the tip of a ski pole within into the pole tip engagements 110 or 112 on the pole tip receiving members 106 or 108 and steady himself or stand up. Due to the large amount of surface area of the skis 102 and 104 and the resistance of the pole tip receiving members 106 and 108 to the slipping of a pole tip, a user can have considerable upper body support to maintain or regain footing or balance even in very deep and soft snow.

In certain embodiments the pole tip receiving members 106 and 108 may be coupled to the snow traversal devices 102 and 104 by a fastener (not shown) such as a screw, rivet, clip, or other mechanical fastener as is known in the art. In another embodiment the pole tip receiving members 106 and 108 may be coupled to the snow traversal devices 102 and 104 by an adhesive. In certain embodiments the pole tip receiving members 106 and 108 may be removably coupled to the snow traversal devices 102 and 104 by a snap, hook and loop material (Velcro), or other removable fastener.

One of skill in the art will recognize that in certain embodiments the pole tip receiving members 106 and 108 may be used as an assisting apparatus to help a user gain his or her balance in an upright position. This may simply be regaining the upright position after sitting down. In other embodiments the device may be used to regain the upright position after falling. Similarly, one of skill in the art will recognize that the present invention may be used in soft, deep powder as well as on hard packed snow and thus should not be limited to use in soft or deep snow.

Figure 2A:
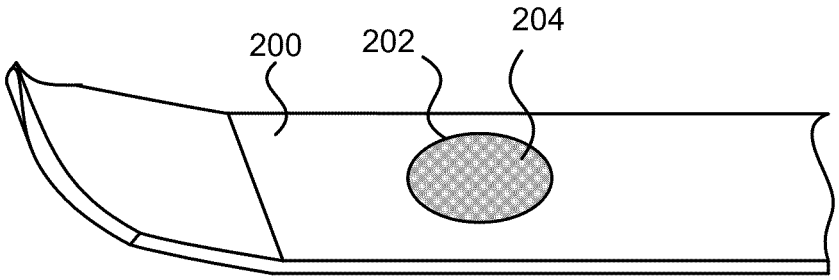
FIGS. 2A and 2B are illustrative close-up perspective views showing increased detail of a pole tip receiving member having pole tip engagements which are non-skid surfaces, in accordance with exemplary embodiments of the invention described herein.
Figure 2B:
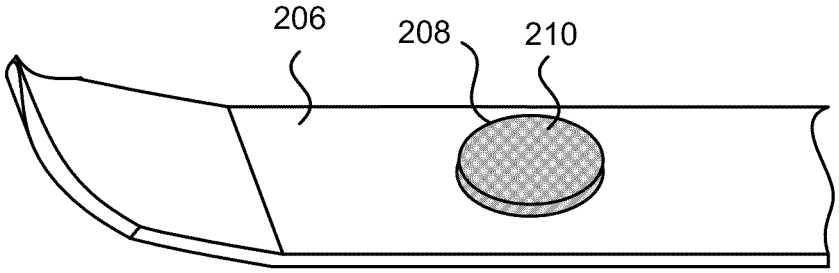

FIGS. 2A and 2B depict close up perspective views of different exemplary embodiments of pole tip receiving members 202 or 208 with pole tip engagements 204 and 210 which are non-skid surfaces. FIG. 2A depicts the tip of a ski 200 with an integral non-skid pole tip receiving member 202. In certain embodiments the non-skid pole tip receiving member 202 includes a pole tip engagement 204 which includes a material that is sufficiently soft and resilient to allow the tip of a pole to grip into the surface of the pole tip engagement 204. In one embodiment, the surface of the pole tip engagement 204 includes a structurally smooth surface. In another embodiment the surface of the pole tip engagement 204 may include a non-skid texture.

An individual may use the pole tip receiving member 202, for example, by placing the distal end of a pole against the non-skid surface of the pole tip engagement 204 and supporting his weight on the proximate end of the pole with his arms. Due to the soft material comprising the of the pole tip engagement 204, the tip of the pole grips the surface of the pole tip engagement 204 to maintain the tip of the pole in substantially the same position on the surface of the ski 200. The greater surface area of the ski 200, as compared to the tip of a pole, allows for support when it may otherwise not be available using the surface of the snow. According to the exemplary embodiment shown in FIG. 2A, the pole tip receiving member 202, is integral with the ski itself. For example, a ski manufacture may build a pole tip receiving member 202 into the ski 200.

FIG. 2B depicts the tip of a ski 206 with a pole tip receiving member 208 similar to that shown in FIG. 2A. However, in this depicted embodiment the pole tip receiving member 208 is not integral with ski 206 but extrinsic to it. For example, the pole tip receiving member 208 may be manufactured separately and attached to the ski 206 by a consumer. In certain embodiments the pole tip receiving member 208 further comprises a bottom side which is configured to be attached to a snow traversing device such as a ski 206. The extrinsic pole tip receiving member 208 is shown with the bottom side attached to the ski 206. According to one exemplary embodiment, the pole tip receiving member 208 is attached by use of an adhesive. According to another exemplary embodiment, the apparatus 208 is attached by use of a screw, rivet, or other a mechanical fastener. In another embodiment the pole tip receiving member 208 may be coupled to the ski 206 or other snow traversal device by an adhesive. In certain embodiments the pole tip receiving member 208 may be removably coupled to the ski 206 or other snow traversal device by a snap, hook and loop material (Velcro), or other removable fastener.

Figure 3A:
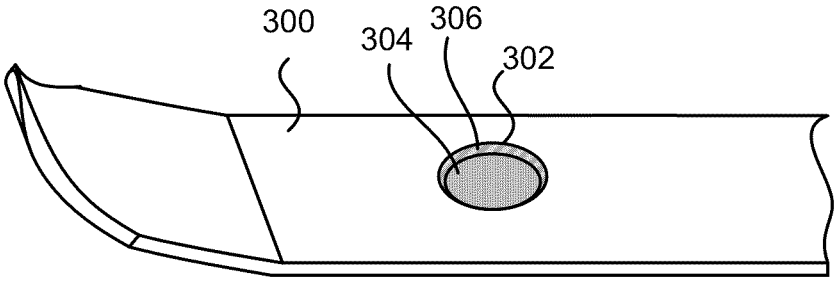
FIGS. 3A and 3B are illustrative close-up perspective views showing increased detail of a pole tip receiving member having pole tip engagements which are pockets, in accordance with one exemplary embodiment of the invention described herein.
Figure 3B:
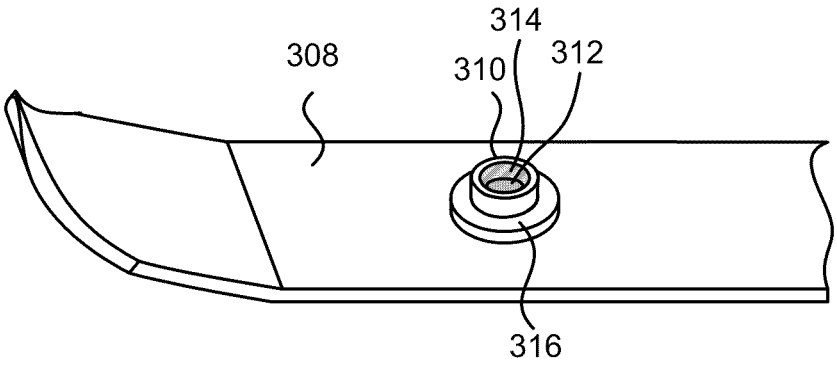

FIGS. 3A and 3B depict close up perspective views of different exemplary embodiments of pole tip receiving members 302 having pole receiving elements 304 which are pockets for receiving a tip of a pole. FIG. 3A depicts the tip of a ski 300 with a pole tip receiving member 302 having pole tip engagement 304 which is a pocket.

In one embodiment the pocket may include an attaching member (not shown) such as a screw thread, hook, or other attachment means to couple the pole the pole tip receiving member 302 and restrict the withdrawal of the tip of the pole from the pole tip receiving member 302. In another embodiment the coupling between the attaching member and the pole may be strong enough to support a user's bodyweight such that a user can pull on the pole to aid the user in regaining or maintaining a standing position. In certain embodiments the pole may include a male thread and the attaching member may include a female thread to couple the pole to the pole tip receiving member.

Where the pole tip receiving members 302 are used to push against to provide support to a user, an individual may regain a standing position by placing the distal end of a pole into the pole tip engagement 304 and supporting his weight on the proximate end of the pole. The tip of the pole is held in place by a wall 306 in the pocket of the pole tip engagement 304. The pole tip receiving member 302 maintains the tip of the pole in substantially the same position and restricts lateral movement of the tip of the pole. Thus, the user can place weight on the proximate end of a pole for upper body balance and support in even very deep, soft snow. The pole tip receiving member 302, according to the embodiment shown, is integral with the ski 300. For example, a manufacture may build such an apparatus into the ski.

FIG. 3B depicts the tip of a ski 308 with a pole tip receiving member 310 similar to that shown in FIG. 3A. The pole tip receiving member 310 also has a pole tip engagement 312 which is a pocket having a wall 314. However, in this depicted embodiment the pole tip receiving member 310 is not integral with ski 308 but extrinsic to it. For example, the pole tip receiving member 310 may have been attached after the manufacture of the ski 308. In certain embodiments, the extrinsic pole tip receiving member 310 further comprises a base 316, the base 316 includes a bottom side which is configured to be attached to a snow traversing device. The extrinsic pole tip receiving member 310 is shown with the bottom side of the base 316 attached to the ski 308. According to one exemplary embodiment, the base 316 is attached by use of an adhesive. According to another exemplary embodiment, the base 316 of the apparatus is attached by use of a screw, rivet, clip, or other a mechanical fastener.

Various considerations should be made when designing a pole tip receiving member because different configurations may have different advantages. For example, when choosing between a pole tip receiving member having a pole tip engagement which is a non-skid surface, as in FIGS. 2A-2B, versus an a pole tip receiving member which has a pole tip engagement which is a pocket, as in FIGS. 3A-3B, the benefits of each should be considered. A non-skid pole tip receiving member such as pole tip receiving members 202 and 208 of FIGS. 2A-2B may be easier to engage with a pole because there is no pocket into which the pole must be inserted. Aiming the tip of a pole from the distal end may be more difficult with a pocket. Also, a non-skid pole tip receiving member such as pole tip receiving members 202 and 208 of FIGS. 2A-2B may be lighter and cheaper to produce because they have fewer structural features. However, a pole tip receiving member which includes a pole tip engagement that is a pocket, such as pole tip engagements 304 and 312 in pole tip receiving members 302 and 310 of FIGS. 3A-3B, offers other benefits. For example, the walls of a pocket make it considerably more difficult for the tip of a pole to slide off of the pole tip engagements. Further, the walls may also enable a user to control the orientation of a snow traversing devices by leveraging a ski pole against the walls of a pocket.

FIGS. 4A through 4D are perspective views of various illustrative embodiments of non-skid pole tip receiving members 400, 406, 414 and 422. The pole tip receiving members 400, 406, 414 and 422 shown are extrinsic to a snow traversing device and are configured to be attached to a snow traversing device. As will be apparent to one skilled in the art, the pole tip receiving members 400, 406, 414 and 422 with their various features and benefits can also be intrinsic to a snow traversing device. For example, the extrinsic pole tip receiving member may be implemented without an attachment feature if they are to be built into a snow traversing device.

Figure 4A:
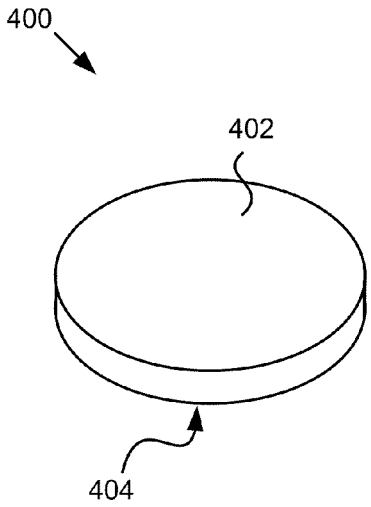
FIGS. 4A through 4D are illustrative perspective views of various exemplary embodiments of pole tip receiving member having pole tip engagements which are non-skid surfaces, in accordance with the present invention described herein.

With regard to FIG. 4A a pole tip receiving member 400 having a pole tip engagement 402 which is a non-skid surface is shown. In the embodiment illustrated in FIG. 4A the surface has a generally smooth structure. In other embodiments the surface of the pole tip engagement 402 may have a variety of textures with varying degrees of skid-resistance. According to one exemplary embodiment, the surface of the pole tip engagement 402 may be made of rubber and have a very fine grained finish for skid-resistance. This increases friction between the tip of a pole and the surface of the pole tip engagement 402. According to another exemplary embodiment, the surface of the pole tip engagement 402 may be made of a soft rubber or other pliable material. In such an embodiment the pliable material may be configured to dynamically form a stop for the tip of the pole when pressure is applied to the pole such that the pliable material stops movement of the tip of the pole.

The surface of the pole tip engagement 402 is preferably made of resilient material such that it can withstand repeated pressure applied through the tip of a pole. According to one exemplary embodiment, the surface of the pole tip engagement 402 may be made of a resilient rubber or plastic. Also, the thickness of the receiving member 400 may vary according to how soft the material is that makes up the pole tip engagement 402. Softer materials may require greater thickness to allow the tip of a pole to sink in more and thus gain better grip. Softer materials may also require greater thickness to resist being quickly damaged. Harder materials, on the other hand, may be thinner because they may be able to better resist pressure repeatedly applied through the tip of a pole.

Figure 4B:
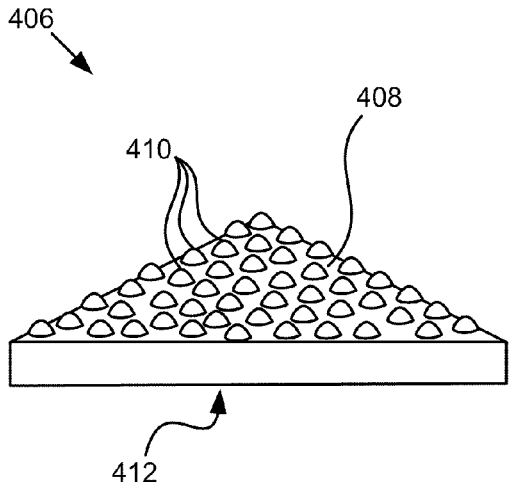

With regard to FIG. 4B a non-skid pole tip receiving member 406 is shown. The pole tip engagement 408 which includes a non-skid surface has a plurality of rounded bumps 410. The rounded bumps 410 help to resist the sliding of a ski pole tip when placed against the surface of the pole tip engagement 408. The non-skid surface of the pole tip engagement 408 having a plurality of rounded structural bumps 410 allows for a smoother surface texture than would otherwise be possible because the bumps 410 provide more resistance to sliding of the pole tip. Further, the surface of the pole tip engagement 408 having a plurality of rounded bumps 410 may also allow for a harder, more resilient material to be used. This is because the structural bumps 410 resist sliding and don't require that a ski pole sink into the material to have grip.

Figure 4C:
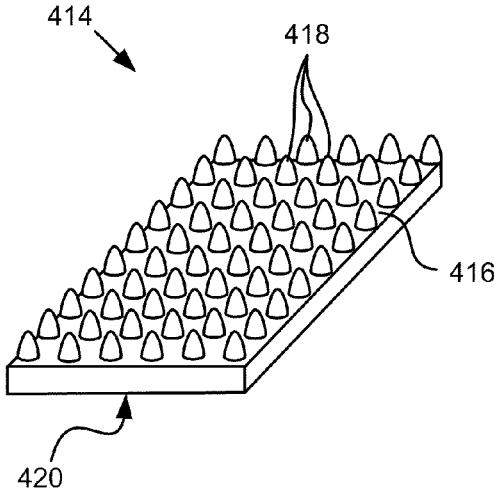

With regard to FIG. 4C another non-skid pole tip receiving member 414 is shown. The non-skid surface of the pole tip engagement 416 includes a plurality of pointed bumps 418. The structural pointed bumps 418, similar to the rounded bumps 410 of FIG. 4B, help to resist the sliding of a ski pole tip when the ski pole tip is placed against the pole tip engagement 416. The pointed bumps 418 may allow the surface of the pole tip engagement 416 to be made of harder material than the surfaces shown in FIGS. 3A-3B because the pointed bumps 418 can grip the ski pole tip better. For example, the in certain embodiments surface of the pole tip engagement 416 may be made of hard plastic, rubber, or even metal materials. In one embodiment the pointed bumps 416 act like teeth to bite into the tip of a pole. In other embodiments a softer material may be used to reduce damage to the tip of a pole.

Figure 4D:
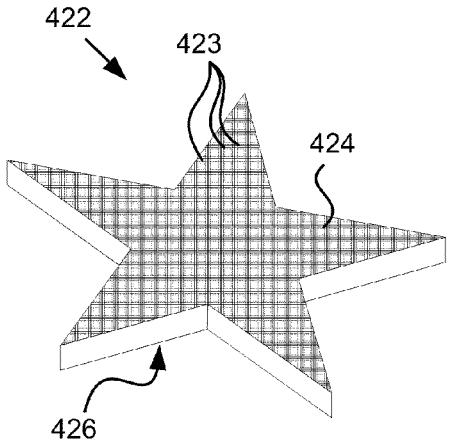

With regard to FIG. 4D another non-skid pole tip receiving member 422 is shown. The pole tip engagement 424 includes a plurality of grooves etched into the surface, giving it a texture similar to that of some common abrasive metal files. This configuration provides considerable friction and can help keep a pole from slipping on the surface of the pole tip engagement 424. The hardness of the surface of the pole tip engagement 424 can also vary with this embodiment. Because of the friction of the texture of the surface of the pole tip engagement 424 it is possible to have little slippage with even very hard metals.

The pole tip receiving members 400, 406, 414, and 422 of FIGS. 4A-4D each comprise a bottom side 404, 412, 420, 426 which may be used to attach the respective non-skid pole tip receiving members 400, 406, 414, 422 to a snow traversing device. As previously mentioned, the apparatus may be attached by use of an adhesive or a mechanical fastener. The adhesive can either be separately applied or be manufactured on the apparatus. For example, the bottom sides 404, 412, 420, 426 of pole tip receiving members 400, 406, 414, and 422 may have a peel-back cover to expose an adhesive for application to a snow traversing device. In other embodiments a mechanical fastener such as a screw, for example, may be driven through the pole tip receiving members 400, 406, 414, and 422 to attach the pole tip receiving members 400, 406, 414, and 422 to a snow traversing device.

As is apparent from the varied shapes of the apparatus of 4A-4D, the apparatus can take various forms and is not limited to a single shape or configuration. For example, a company may wish to sell a pole tip receiving member in the shape of the company logo or a word. Furthermore, the size of the non-skid pole tip receiving member can vary greatly as well. The apparatus are preferably small enough to fit on the surface of a snow traversing device and large enough to easily be engaged with a ski pole.

FIGS. 5A-5E are perspective views of various exemplary embodiments of pole tip receiving members 500, 510 520, 530, and 540 having pole tip engagements 502, 512, 522, 532, and 542 that include an pocket for receiving a tip of a pole. The pole tip receiving members 500, 510 520, 530, and 540 shown are extrinsic to a snow traversing device and are configured to be attached to a snow traversing device. As will be apparent to one skilled in the art, the pole tip receiving members 500, 510 520, 530, and 540 with their various features and benefits can also be formed intrinsic to a snow traversing device.

Figure 5A:
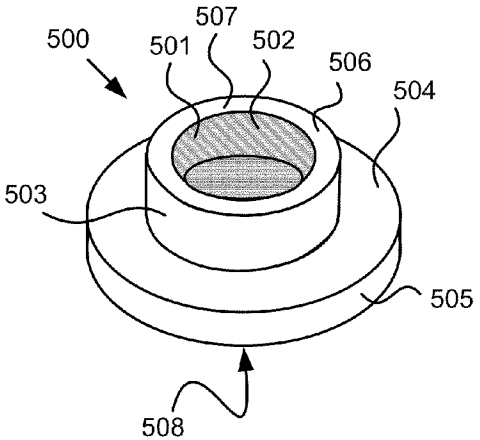
FIGS. 5A through 5E are illustrative perspective views of various exemplary embodiments of pole tip receiving members having pole tip engagements which are pockets formed in protrusions, in accordance with the present invention described herein.

FIG. 5A depicts a pole tip receiving member 500 having a pole tip engagement 502 that includes a pocket and a base 504. The pocket of the pole tip engagement 502 is formed with a cylindrical shape 506 that protrudes from the base 504, the walls of the cylinder 506 and the surface of the base 504 are at right angles. The pocket of the pole tip engagement 504 has a circular opening and the base 504 has a circular shape. The base 504 has a bottom side 508 which is configured to be attachable to a snow traversing device such as by adhesion or a mechanical fastener. The bottom side 508 may be flat or may be shaped according to the shape of a snow traversing device to which it is meant to be attached. For example, some alpine skis have rounded or ridged surfaces and in certain embodiments the bottom side 508 may be shaped to fit onto such surfaces. In another embodiment the base 504 may be made of a pliable material that form fits the contours of top of the snow traversing device.

It will be clear to one skilled in the art that the configuration of the apparatus 500 can vary greatly. For example, the walls of the cylinder 506 in which the pocket of the pole tip engagement 502 is formed need not be at right angles to the base 504. Furthermore, the shape of the pole tip engagement 502, base 504, and cylinder 506 may be in any number of shapes and need not be a similar shape. For example, in certain embodiments the pole tip engagement 502 may have a triangular opening with the cylinder 506 having a cylindrical cross-section, and the base 504 having a square shape.

In an exemplary embodiment the pole tip engagement 502 includes a cylinder 506 having an inner wall 501 that is at an obtuse angle with respect to the base 504. In one embodiment the inner wall 501 of the cylinder 506 is at an angle of between about 100 and 120 degrees. As the angle of the inner wall 501 is increased respect to the base 504, the ability of the inner wall 501 to maintain a pole within the pocket of the cylinder 506 is decreased.

In certain embodiments the inner wall 501 of the cylinder 506 determines the depth of the pocket. The pocket should be sufficiently deep to engage a pole tip and limit the lateral movement of the pole tip on the surface of the snow traversing device. In an exemplary embodiment the inner wall 501 of the cylinder are between about ¼ of an inch and about ¾ of an inch. An inner wall 501 less than about ¼ of an inch may not provide a deep enough pocket to sufficiently engage the tip of a pole. An inner wall 501 greater than about ¾ of an inch may be so deep that a pole may be difficult to disengage from the pocket. In certain embodiments a user may wish to secure a pole to the inner wall 501 of the pocket such as where a user wishes to engage a monopod in the pocket to steady a camera. Therefore, in certain embodiments, such as where a user wishes to secure the pole to the pole tip receiving member 500 the inner wall 501 of the pocket may be greater than ¾ of an inch.

In one embodiment the cylinder 506 also includes an outer wall 503. In an exemplary embodiment the outer wall 503 may be disposed at a 90 degree angle with respect to the base 504. In an alternative embodiment, such as the embodiment illustrated in FIG. 5D discussed below, the outer wall 503 may be disposed at an angle with respect to the base 534.

In an exemplary embodiment the bottom side 508 of the base 504 may include between one and a half and two times as much surface area as the surface area occupied by the cylinder 506. For example, in one embodiment the base 504 may be about 2 inches in diameter with the diameter of the outer wall 503 of the cylinder 506 being about 1 inch. The added surface area of the bottom surface 508 of the base 504 provides an increased surface area for connecting the pole tip receiving member 500 to a top surface of a snow traversing device.

In certain embodiments the base 504 has a side wall 505 thickness of between about ⅛ of an inch and about ¼ of an inch. One of skill in the art will recognize that the base 504 should have sufficient rigidity to support the cylinder 506 particularly where the cylinder 506 has pressure applied to the inner wall 501 by a pole. Therefore, in one embodiment the base 504 may have a side wall 505 thickness of between about ⅛ of an inch and about ½ of an inch.

Similarly, in order to support pressure applied to the inner wall 501 of the cylinder 506 by a pole, the cylinder 506 may have a wall 507 with a thickness of between about 1/16 of an inch and about ¼ of an inch. In one embodiment, such as the embodiment illustrated in FIG. 5E discussed below, the wall 507 may extend all the way to edge of the base 544. In such an embodiment the sidewall 505 of the base 504 may be increase to provide an pole tip engagement 542 having sufficient depth to engage a tip of a pole.

Figure 5B:
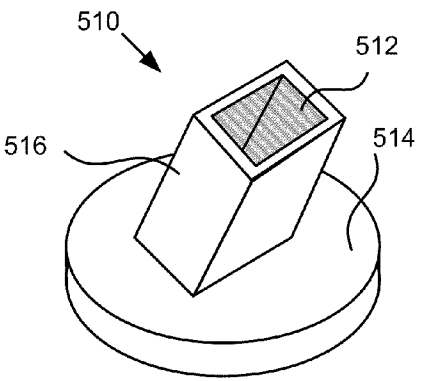

FIG. 5B depicts a pole tip receiving member 510 illustrating a possible variation of the configuration of FIG. 5A. The pole tip receiving member 510 has pole tip engagement 512 with a rectangular shaped opening in a rectangular shaped protrusion 516 on a circular base 514. The walls of the protrusion 516 are not at right angles with the base. This configuration may be desirable, for example, where a pole will be inserted from angles other than right angles to the surface of a ski traversing device.

Figure 5C:
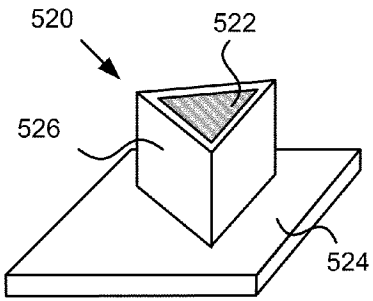

Another variation of a pole tip receiving member 510 is depicted in FIG. 5C. The pole tip receiving member 510 includes a pocket having a triangular opening formed in a protrusion 526 with a triangular cross-section. In the illustrated embodiment the base 524 is square.

Figure 5D:
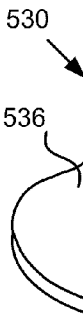

A further variation of a pole tip receiving member 530 is depicted in FIG. 5D. The pole tip receiving member 530 has circular pole tip engagement 532, a circular base 534, and a protrusion 536 that smoothly transition into the base 534. Thus, the protrusion 536 and base 534 form a sloped surface. Such a configuration may be preferable to minimize the snagging of the pole tip or other objects on the protrusion 536.

Further, such a configuration may also reduce the likelihood that the pole tip receiving member 530 will be ripped off of a snow traversing device.

Figure 5E:
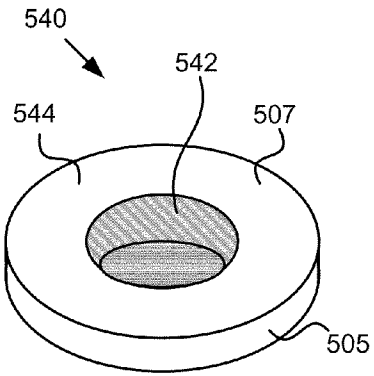

Another variation of a pole tip receiving member 540 is depicted in FIG. 5E. The pole tip receiving member 540 includes pole tip engagement 542 having a base 544 with an orifice disposed therethrough. The embodiment illustrated in FIG. 5E does not include a protrusion like the embodiments illustrated in FIGS. 5A-5D. However, similar to the previous embodiments, the pole tip receiving member 540 may be attached to a ski traversing device by mechanical or chemical fasteners. A tip of a ski pole placed in the orifice in the pole tip engagement 542 is restricted from moving laterally on the surface of the snow traversal device. This embodiment may be desirable because of its simplicity and its low profile to eliminate snags.

Figure 5F:
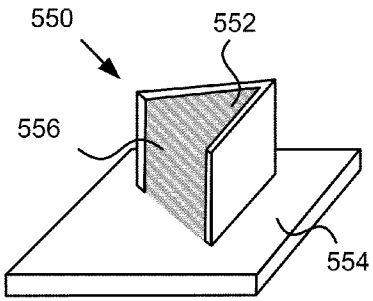

FIG. 5F illustrates another embodiment of a pole tip receiving member 550 which includes a pole tip engagement 552 and a base 554. In certain embodiments the pole tip engagement 552 is formed as a stop configured to arrest movement of a pole tip across the supporting substrate of the snow traversal device. Thus, in the embodiment illustrated in FIG. 5F the pole tip engagement 552 is a v-shaped stop with an opening 556 at one end. In use a tip of a pole is received within the opening 556 and the v-shaped pole tip engagement 552 stops movement of the pole tip across the surface of the snow traversal device. While the pole tip engagement 552 illustrated in FIG. 5F is v-shaped, one of skill in the art will recognize that in certain embodiments the pole tip engagement 552 may me shaped in other shapes such as a simple wall or a half-circle having sufficient height to arrest the movement of a pole tip across the supporting substrate of the snow traversal device.

As used in the present disclosure, the supporting substrate of the snow traversal device may include the top surface, the bottom surface or the entire supporting structure including the top and bottom surfaces as well as any intervening material of a ski, snowshoe or other device adapted to traverse snow.

It should be understood from the apparatus of FIGS. 5A-5F that there is considerable variation possible in the shape and configuration of the pocket, protrusion and base. Also, the size of the apparatus and pocket features can vary as well.

FIGS. 6A-6E are cross-sectional views of various different embodiments of the interior shape of a pocket in the pole tip engagement. With regard to FIG. 6A a cross-section of an exemplary pocket 600 is shown. The pocket 600 has inner walls 602 and a floor 604. The opening of the pocket 600 is sufficiently large to receive the tip of a ski pole and the pocket is the same diameter from top to bottom. The angle between the floor 604 and the inner walls 602 is approximately a right angle. It is important to note that although the cross-sectional view of the pocket as depicted is rectangular, the opening of the pocket may be in any number of shapes, such as squares, circles, or triangles.

The inner walls 602 of the pocket 600 hold an inserted pole tip in substantially the same location by not allowing it to slip from the apparatus or snow traversing device. Furthermore, the pocket 600, if the inner walls 602 are sufficiently high, can allow a user to control the orientation of an attached snow traversing device by leveraging the inner walls 602 with the tip of a pole.

Figure 6A:
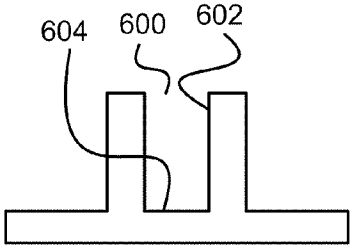
FIGS. 6D through 6E are illustrative cross-sectional views showing various exemplary embodiments of pocket configurations for pole receiving features, in accordance with the present invention described herein.
Figure 6B:
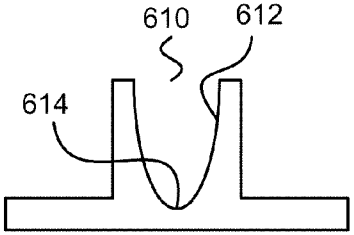

With regard to FIG. 6B another cross-section of an exemplary pocket 610 is shown. The inner walls 612 of the pocket 610 are smoothly tapered from a larger area at the opening of the pocket 610 to a smaller area at the floor 614. The larger opening of the pocket 610 makes it easier to place the tip of a pole in the pocket 610. If the opening is just barely larger than the tip of a ski pole, it may be difficult to insert the tip when holding on the handle at the distal end of a ski pole. Even though the opening is large, the smaller floor 614 area still holds the tip of the pole in substantially the same location to limit sliding. If the floor 614 is too large, the pole tip may move and slide too much making the apparatus difficult to use.

Figure 6C:
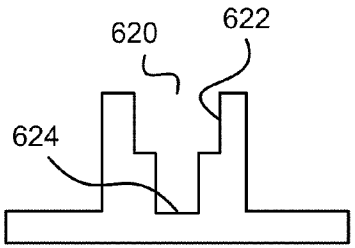

With regard to FIG. 6C another cross-section of an exemplary pocket 620 is shown. The inner walls 622 of the pocket 620 are step-wise tapered from a larger area at the opening of the pocket 620 to a smaller area at the floor 624. The larger opening of the pocket 620 makes it easier to place the tip of a pole in the pocket 620. Thus, it has similar advantages to those discussed in relation to FIG. 6B. However, the step-wise tapering of the inner walls 622 illustrated in FIG. 6C may make it easier to control the orientation of an attached snow traversing device. Furthermore, an inserted pole is less likely to slip out of the pocket 620 than embodiments where the walls 622 are smoothly tapered.

Figure 6D:
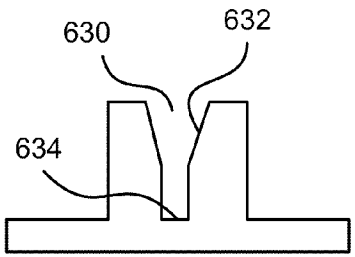

FIG. 6D depicts another cross-section of an exemplary pocket 630. The pocket 600 has inner walls 632 with a sloped section and a vertical section. The vertical section of the walls 632 proceed only partway from the opening to the floor 634 at which point the walls are oriented at right angles to the floor 634 and proceed the remaining distance to the floor.

The configuration of the pocket 630 allows the tip of a ski pole to be easily inserted into the pocket 630. This configuration offers a further advantage in that the lower portion of the pocket 630 is much smaller in cross-section further away from the floor 634 and thus holds a pole securely. This keeps the pole from slipping from the pocket 630 before the user is ready and also allows a user to leverage the walls 632 of the pocket with a ski pole to control the orientation of an attached snow traversing device.

Figure 6E:
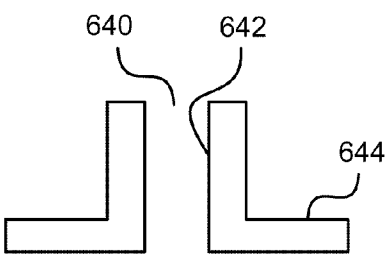

FIG. 6E is a cross-sectional view of yet another exemplary pocket 640 configuration. The pocket 640 has walls 642 with sides at right angles to the base 644. The configuration is similar to that of pocket 600 of FIG. 6A. However, the pocket 640 of FIG. 6E has no floor. Where the apparatus containing the pocket 640 is attached to a snow traversing device, the surface of the snow traversing device operates as a floor. In certain embodiments the lack of a floor makes the apparatus lighter.

The apparatus as described in relation to the forgoing figures have various advantages. For example, they make use of the already existing surface area of devices that snow travelers generally have with them. Also, a small pole tip receiving member allows for the use of a variety of conventional ski and hiking poles making it unnecessary to use unwieldy or awkward poles.

Furthermore the apparatus allow the ski poles to be used in conjunction with the already available surface area of the snow traversing device. Snow traversing devices, with a few exceptions, are usually made of hard, slick material which provides little or no friction between the tip of a pole and the snow traversing device. Thus, if a user places the tip of a pole against the surface of a snow traversing device, it will generally slip off and cause the user to lose balance. In the few cases that the device is not made from material which will cause the pole to slip, snow traversing devices are made from material that would be damaged by using a ski pole. For example, snowshoes that use cloth-like material to span the frames of the snowshoe would be damaged by placing the tip of a ski pole against the material and placing a user's weight on the pole.

Thus, the present invention provides a convenient surface for a user to place the tip of a pole which will not allow the tip of the pole to slip from the surface of a snow traversing device and is durable to resist damage from the pole.

Using the apparatus and system of the present invention, a pole can be used by the arms to help maintain the upper body of a user in a desired position. The pole tip receiving member can allow a user to maintain or regain balance while a snow traversing device is strapped to a users feet or even when they are not. As an example, a user may be hiking up a slope with a snow traversing device strapped to his/her back. The user may encounter a deep area of snow and sink in to the snow. The depth and softness of the snow may make it very difficult to get back out. However, it may be difficult to stand up on the snow traversing devices because any attempt to use the arms or any ski poles would result in the arm or pole simply sinking into the snow.

Using a snow traversing device with a pole tip receiving apparatus, such as those described above, will allow the user to gain support and balance for his upper body so that he may stand and proceed to move through the snow. Rather than attempting to use the poles placed against the snow to provide support while standing, a user can place the poles on the pole receiving feature of an apparatus. The natures of the apparatus are such that the tip of a ski pole will not slip when an individual's places his weight on the pole.

The system also has other available utilities. For example, it is often very important for cameramen to have a very stable base for a camera. The use of tripods and other similar tools helps to stabilize a camera for better picture taking. Other optical devices, such as telescopes or spotting scopes, also require a stable base. Tripods, bipods, monopods and other similar tools tend to be less useful in soft snow because the legs of the pods often sink into the snow and even then will continue to settle thereafter. For example if more weight is applied by touching the stand or a camera mounted thereon the whole setup may be altered. Even the sun heating up the pod may cause it to melt the surrounding snow causing it sink further.

A camera man may gain sufficient stability for his camera by simply placing the legs of the tripod, bipod, monopod etc. on a pole tip receiving member mounted to a snow traversing device. The surface area of the snow traversing device will maintain the camera in the same position on top of the snow and will allow the camera man to get better pictures. Likewise, a spotting scope may be mounted in a similar manner and allow better viewing of what is being spotted.

The pole tip receiving apparatus as described herein can be used within various systems and on various snow traversing devices. Returning to FIG. 1, FIG. 1 is an illustration of one exemplary embodiment of a system using the pole receiving apparatus. The system comprises a first and second alpine, telemark, cross-country or skate ski, 102 and 104. Each ski 102 and 104 has a pole tip receiving member 106 and 108 respectively. The first ski 102 has a pole tip receiving member 106 near the front end of the ski 102. The second ski 104 has a pole tip receiving member 108 near the back end of the ski 104. This placement of the pole tip receiving members 106 and 108 can lead to better support. For example, in FIG. 1, a user could simultaneously use two poles, one on the first pole tip receiving member 106 to the front and one on the second pole tip receiving member 108 to the rear, to support himself or regain footing or stability.

Figure 7:
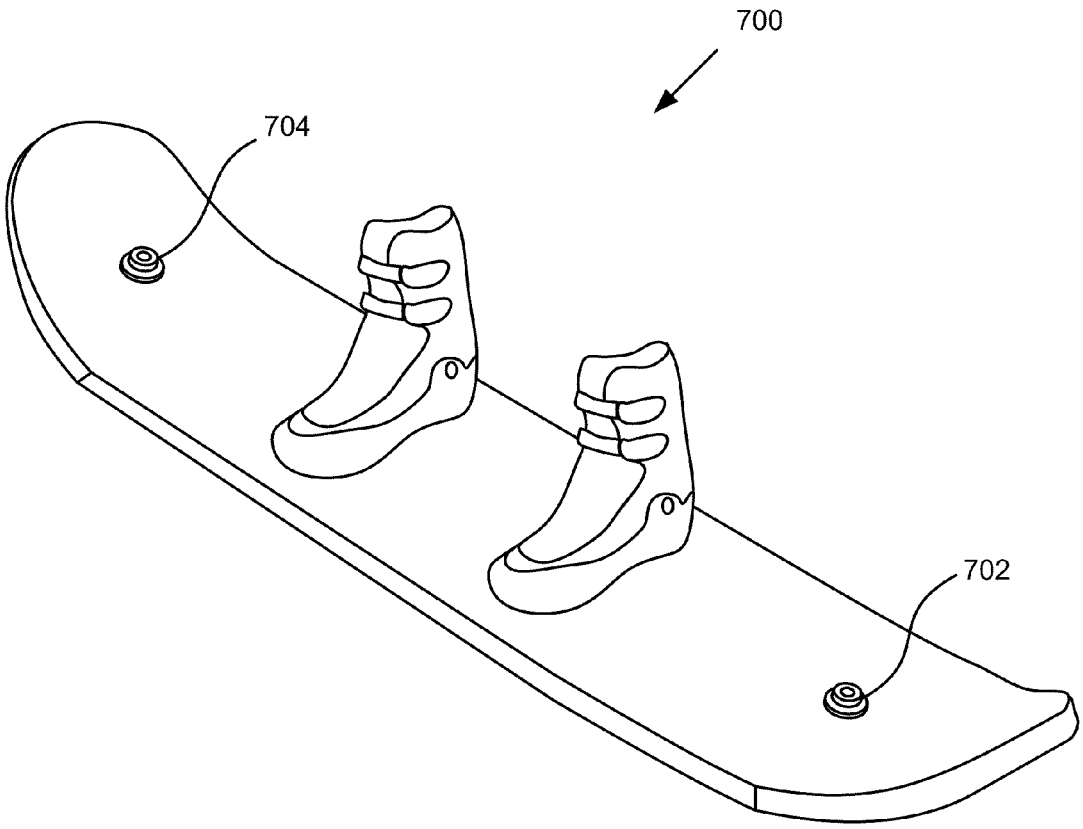
FIG. 7 is an illustrative perspective view of an exemplary embodiment of a snow traversing system in accordance with the present invention described herein.

FIG. 7 is an illustration of another exemplary system utilizing pole tip receiving apparatus. This system includes a snowboard 700 having first pole tip receiving member 702 and a second pole tip receiving member 704. The first and second pole tip receiving members 702 and 704 are located at opposite ends of the snowboard 700. Although snowboarders generally don't use poles while riding the snowboards, they will often carry poles while hiking or snowboarding in backcountry areas to assist in hiking and maintaining balance in snow. Once again, a user of this system may use one pole or two poles to maintain balance or gain support for his upper body while standing.

Figure 8:
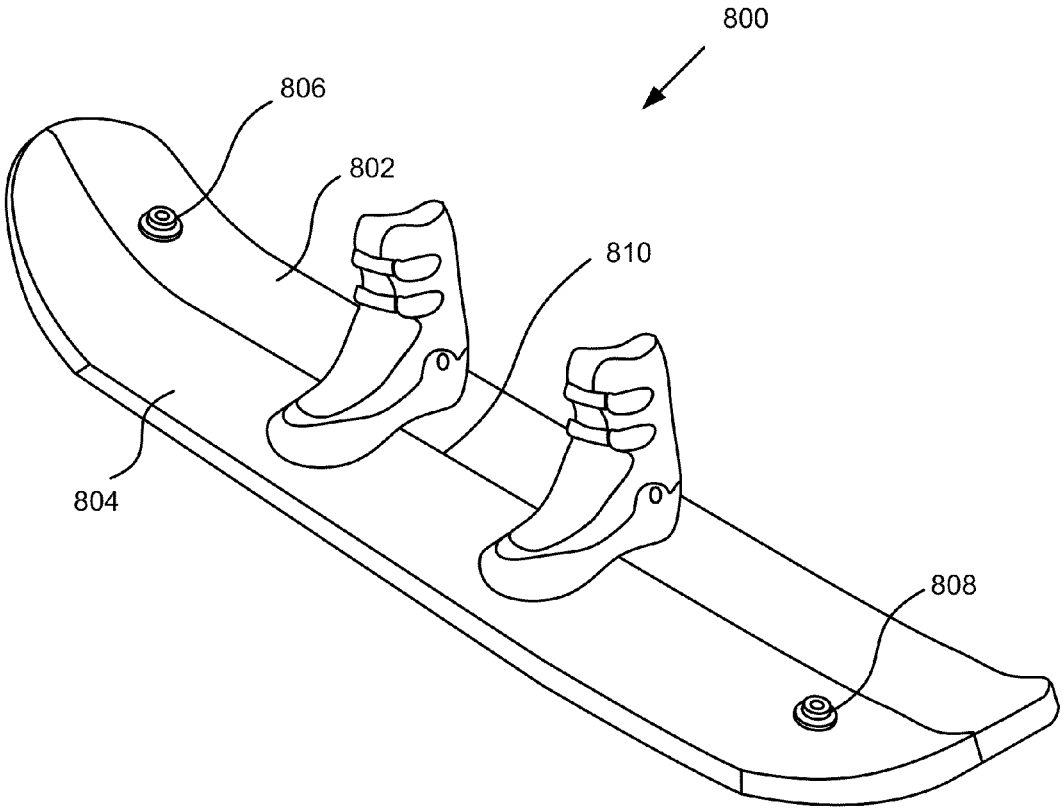
FIG. 8 is an illustrative perspective view of an exemplary embodiment of a snow traversing system in accordance with the present invention described herein.

FIG. 8 is an illustration of a split snowboard 800 that includes two pole tip receiving apparatus 806 and 808. A split board 800, as is known in the art, is a snowboard which can split into two skis 804 and 802, along a seam 810, for traversing slopes, going up slopes, or traveling through snow. A user can then reunite the skis 802 and 804 into a snowboard which can be ridden down the mountain like a normal snowboard.

As shown in FIG. 8, a first pole tip receiving member 806 is attached to one end of the split snowboard 800 on one side of the seam 810 while a second pole tip receiving member 808 is attached to the other end of the split snowboard 800 on the other side of the seam 810. Thus, when the skis 802 and 804 are united along the seam 810 the system can be used similar to the snowboard in FIG. 7. When the skis 802 and 804 are separated, however, the system can be used similar to the alpine ski system of FIG. 1.

As discussed above, while the embodiments illustrated in FIGS. 1, 7, and 8 are depicted having two pole tip receiving members, one of skill in the art will recognize that in certain embodiments the snow traversing device(s) may include only one pole tip receiving member. Similarly, in other embodiments the snow traversing device(s) may include more than two pole tip receiving members.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus configured to receive a pole tip and to assist a user to achieve a standing position in snow, the apparatus comprising:

a pole tip receiving member comprising a base and a pole tip engagement, the pole tip engagement comprising a pocket having an opening and a floor, wherein a cross sectional area of the pocket at the opening of the pocket is greater than a cross sectional area of the pocket at the floor, the opening of the pocket comprising an area substantially larger than a diameter of a pole to facilitate receiving a tip of the pole within the pocket when the pole is oriented at a nonperpendicular orientation with respect to a surface of a snow traversal device, the smaller cross sectional area at the floor of the pocket limiting lateral movement of the pole with respect to the pole tip receiving member; and a coupling configured to secure the pole tip receiving member to the snow traversal device, wherein engagement of the pole by the pole tip receiving member transfers a pressure applied by the pole to a supporting substrate of the snow traversal device, the transfer of the pressure applied by the pole increasing the effective surface area of the pole.

2. The apparatus of claim 1, wherein the opening is sized to receive the tip of the pole, the pocket comprising an inner wall configured to limit lateral movement of the pole.

3. The apparatus of claim 2, wherein the inner wall of the pocket is tapered.

4. The apparatus of claim 1, wherein the opening of the pocket is circular and disposed around a central axis, wherein the inner wall of the pocket comprises a plurality of consecutively smaller openings concentrically disposed around the central axis such that pocket is stepwise tapered from a larger area at the opening to consecutively smaller openings, the pocket terminating at the floor.

5. The apparatus of claim 1, wherein the pocket comprises a sloped outer wall to facilitate engagement of the pole within the pole tip engagement, the sloped outer wall smoothly transitioning from the opening of the pocket to the base.

6. The apparatus of claim 1, wherein the base comprises a planar member having an orifice disposed therethrough, wherein the orifice comprises the pole tip engagement.

7. The apparatus of claim 1, wherein the pole tip engagement comprises a stop configured to arrest movement of a pole tip across the supporting substrate of the snow traversal device.

8. The apparatus of claim 1, wherein the pole tip engagement comprises a textured surface configured to engage a tip of the pole.

9. The apparatus of claim 1, wherein the pole tip engagement comprises a pliable material configured to dynamically form a stop for the tip of the pole when pressure is applied to the pole such that the pliable material stops movement of the tip of the pole.

10. The apparatus of claim 1, wherein the pole tip receiving member further comprises an attaching member configured to couple the tip of the pole to the pole tip receiving member, the attaching member restricting withdrawal of the tip of the pole from the pole tip receiving member such that a user can pull on the pole to achieve a standing position.

11. The apparatus of claim 1, wherein the pole tip engagement comprises an orifice in a top surface of the supporting substrate of the snow traversing device and wherein the base member comprises the top surface of the supporting substrate of the snow traversing device.

12. A system for assisting a user in achieving a standing position in snow, the system comprising:

a snow traversing device comprising a supporting substrate;

a pole tip receiving member disposed on the supporting substrate, the pole tip receiving member comprising a pole tip engagement having an opening and a floor, wherein a cross sectional area of the pole tip engagement at the opening is greater than a cross sectional area of the pole tip engagement at the floor, the larger cross sectional area at the opening comprising an area substantially larger than a diameter of a pole to facilitate receiving a tip of the pole within the pole tip engagement when the pole is oriented at a nonperpendicular orientation with respect to the supporting substrate of the snow traversing device, the smaller cross sectional area at the floor limiting lateral movement of the pole with respect to the pole tip receiving member; and wherein engagement of the pole by the pole tip receiving member transfers a pressure applied by the pole to the supporting substrate of the snow traversal device, the transfer of the pressure applied by the pole increasing the effective surface area of the pole.

13. The system of claim 12, wherein the pole tip engagement comprises an orifice in a top surface of the supporting substrate of the snow traversing device and wherein the base member comprises the top surface of the supporting substrate of the snow traversing device.

14. The system of claim 12, wherein the pole tip engagement member comprises a pocket and wherein the opening is sized to receive the tip of the pole, the opening comprising an inner wall configured to limit lateral movement of the pole.

15. The system of claim 14, wherein the inner wall of the pocket is tapered such that the cross sectional area of the pole tip engagement at the opening is greater than the cross sectional area of the pole tip engagement at the floor.

16. The system of claim 14, wherein the opening of the pole tip engagement is circular and disposed around a central axis, wherein the inner wall of the pocket comprises a plurality of consecutively smaller openings concentrically disposed around the central axis such that the pocket is stepwise tapered from a larger area at the opening to consecutively smaller openings, the pocket terminating at the floor.

17. The system of claim 12, wherein the pole tip engagement comprises a pliable material configured to dynamically form a stop for the tip of the pole when pressure is applied to the pole such that the pliable material stops movement of the tip of the pole.

18. The system of claim 12, wherein the pole tip receiving member further comprises an attaching member configured to couple the tip of the pole to the pole tip receiving member, the attaching member restricting withdrawal of the tip of the pole from the pole tip receiving member such that a user can pull on the pole to achieve a standing position.

19. An apparatus configured to receive a pole tip and to assist a user to achieve a standing position in snow, the apparatus comprising:

a pole tip receiving member comprising a base and a pole tip engagement, the pole tip engagement configured to engage a tip of a pole and to limit lateral movement of the pole with respect to the pole tip receiving member, the pole tip engagement comprising a pocket having an opening having a cross sectional area substantially larger than a diameter of a pole to facilitate receiving a tip of the pole within the pocket when the pole is oriented at a nonperpendicular orientation with respect to a supporting substrate of a snow traversal device, the opening comprising an inner wall configured to limit lateral movement of the pole, wherein the opening of the pole tip engagement is circular and disposed around a central axis, wherein the inner wall of the pocket comprises a plurality of consecutively smaller openings concentrically disposed around the central axis such that the pocket is stepwise tapered from a larger area at the opening to consecutively smaller openings; and a coupling configured to secure the pole tip receiving member to the snow traversal device, wherein engagement of the pole by the pole tip receiving member transfers a pressure applied by the pole to the supporting substrate of the snow traversal device, the transfer of the pressure applied by the pole increasing the effective surface area of the pole.

20. The apparatus of claim 19, wherein the pocket further comprises a floor, wherein the inner wall of the pocket is tapered such that the cross sectional area of the pocket at the opening is greater than a cross sectional area of the pocket at the floor.

* * * * *